US012291925B1

(12) United States Patent
Lay et al.

(10) Patent No.: US 12,291,925 B1
(45) Date of Patent: May 6, 2025

(54) UNDERREAMER DRILL HAMMER

(71) Applicant: Center Rock Inc., Berlin, PA (US)

(72) Inventors: Warren Thomas Lay, Catawba, VA (US); Austin C. Hine, New Florence, PA (US)

(73) Assignee: Center Rock Inc., Berlin, PA (US)

( * ) Notice: Subject to any disclaimer, the term of this patent is extended or adjusted under 35 U.S.C. 154(b) by 0 days.

(21) Appl. No.: 18/491,085

(22) Filed: Oct. 20, 2023

(51) Int. Cl.
*E21B 10/36* (2006.01)

(52) U.S. Cl.
CPC ..... *E21B 10/36* (2013.01)

(58) Field of Classification Search
CPC ..... E21B 10/32; E21B 10/327; E21B 10/36; E21B 10/40; E21B 10/62
See application file for complete search history.

(56) References Cited

U.S. PATENT DOCUMENTS 5,004,056 A * 4/1991 Goikhman ..... E21B 10/56 175/413
5,139,099 A * 8/1992 Hayashi ..... E21B 10/38 175/413
5,174,390 A * 12/1992 Kurt ..... E21B 7/28 175/96
8,104,551 B2 * 1/2012 Nakamura ..... E21B 10/627 299/113
8,141,660 B2 * 3/2012 Furuki ..... E21B 4/14 175/96
8,439,135 B2 * 5/2013 Lyon ..... E21B 10/32 175/286
9,033,068 B2 * 5/2015 Lee ..... E21B 10/32 175/286
10,563,462 B2 * 2/2020 Ahonen ..... E21B 7/20
12,071,816 B2 * 8/2024 Graham ..... E21B 7/28
2010/0018774 A1 * 1/2010 Furuki ..... E21B 4/14 175/418
2010/0175928 A1 * 7/2010 Lee ..... E21B 10/36 175/414
2010/0236831 A1 * 9/2010 Nakamura ..... E21B 17/076 175/292
2011/0240373 A1 * 10/2011 Lyon ..... E21B 7/208 175/267
2018/0179824 A1 * 6/2018 Ahonen ..... E21B 10/66
(Continued)

FOREIGN PATENT DOCUMENTS

FI 125342 B * 8/2015 ..... E21B 10/32
GB 2031481 A * 4/1980 ..... E21B 10/40
JP H0441891 A * 2/1992 ..... E21B 10/32
(Continued)

*Primary Examiner* — Jennifer H Gay
(74) *Attorney, Agent, or Firm* — Kim IP Law Group LLC

(57) ABSTRACT

An underreamer drill hammer comprising a canister including a housing having an outer diameter, a proximal end configured for attachment to a drill string, and a percussive drill hammer housed within the housing, the percussive drill hammer having a drill bit movable between a radially retracted position and a radially extended position. The drill bit can rotate and is designed in a manner that the drill bit head cams, pivots, or swings out to a larger cutting diameter when the system is rotated in a first direction. The system is rotated in a second direction to retract the bit heads. The bits are retracted to remove the canister from the casing or to drill a smaller diameter hole through rock.

21 Claims, 9 Drawing Sheets

(56) References Cited

U.S. PATENT DOCUMENTS

| | | | | | |
|---|---|---|---|---|---|
| 2023/0184040 | A1* | 6/2023 | Graham | ..... | E21B 10/40<br>175/53 |

FOREIGN PATENT DOCUMENTS

| | | | | | | |
|---|---|---|---|---|---|---|
| JP | H0921294 | A | * | 1/1997 | ..... | E21D 9/06 |
| JP | 2000104475 | A | * | 4/2000 | | |
| JP | 2003314182 | A | * | 11/2003 | | |
| KR | 960006710 | Y1 | * | 8/1996 | ..... | E21B 7/00 |
| KR | 20100071560 | A | * | 6/2010 | ..... | E21B 1/38 |
| KR | 20110116603 | A | * | 10/2011 | ..... | E21B 10/32 |
| KR | 20130020648 | A | * | 2/2013 | ..... | E21B 10/36 |
| KR | 20170044427 | A | * | 4/2017 | ..... | E21B 10/26 |
| KR | 20200134923 | A | * | 12/2020 | ..... | E21B 4/14 |
| WO | WO-2010137798 | A2 | * | 12/2010 | ..... | E21B 10/26 |

* cited by examiner

UNDERREAMER DRILL HAMMER

FIELD OF THE INVENTION

The exemplary embodiments of present disclosure relate generally to a drilling device and, more specifically, to a low profile underreamer drill hammer for advancing casing through soil and overburden to bedrock, and for drilling a hole into rock smaller than the casing diameter to provide a deeper hole for anchoring while still providing a solid foundation for the casing.

BACKGROUND OF THE DISCLOSURE

Large diameter casings are used to provide ground support in infrastructure and construction projects. The most common method of installing these casings includes affixing rings with cutting teeth or carbide inserts to the bottom of the casing and using a specialized drill bit to drive the casing down as the bit advances. In permanent casing installations the rings cannot be retrieved and remain at the bottom of the hole, i.e., they are not reusable. Further, the large diameter drill bit is susceptible to wear and expensive to procure. Installing casing in this manner is expensive and requires ample planning with long lead-times to procure the rings and bits.

An advantage exists, therefore, for a reusable system that can advance large diameter casing without the need for special mono-hammer bits and large, expensive drive shoes for each casing being installed.

BRIEF SUMMARY OF THE DISCLOSURE

In accordance with an exemplary embodiment there is provided an underreamer drill hammer comprising a canister including a housing having an outer diameter, a proximal end configured for attachment to a drill string, and a percussive drill hammer housed within the housing, the percussive drill hammer having a drill bit movable between a radially retracted position and a radially extended position.

According to an aspect, rotation of the canister in a first direction moves the drill bit into the radially extended position and rotation of the canister in a second direction opposite the first direction moves the drill bit into the radially retracted position.

According to an aspect, the drill bit comprises a shank having a longitudinal axis and a distally facing end having a medial end spaced from the longitudinal axis a distance greater than a lateral end of the distally facing end.

According to an aspect, the drill bit comprises a distally facing end having a perimeter defined by a first arcuate portion having a first arc length, and a second arcuate portion having a second arc length greater than the first arcuate portion. According to another aspect, the first arcuate portion is defined by a first radius and the second arcuate portion is defined by a radius less than the first radius. According to another aspect, the perimeter of the distally facing end is further defined by a third portion having a third perimeter length less than the first arc length. According to another aspect, the perimeter of the distally facing end is further defined by a fourth portion having a fourth perimeter length less than the third perimeter length.

According to an aspect, in the radially retracted position, the drill bit does not extend radially outwardly further than an outer diameter of a casing. According to another aspect, in the radially extended position, the drill bit extends radially beyond an outer diameter of a casing.

According to an aspect, the drill bit comprises a head including a first curved peripheral surface, a second curved peripheral surface having a curve steeper than the first curved peripheral surface, and a third peripheral surface.

According to an aspect, the underreamer drill hammer further comprises a stop about a distal end of the canister for engaging the drill bit. According to another aspect, the stop is positioned spaced from a longitudinal axis of a shank of the drill bit so as to abut adjacent the medial end or lateral end of the distally facing end of the drill bit. According to another aspect, the stop includes a first face for engaging the drill bit when moved in the radially extended position and a second face for engaging the drill bit when moved in the radially retracted position. According to another aspect, the drill bit comprises a head having an arcuate portion, and wherein the stop engages a first end of the arcuate portion when in the radially extended position and a second send end of the arcuate portion opposite the first end when in the radially retracted position.

According to an aspect, the canister further comprises a plate at its distal end, and wherein the plate includes a recess for receiving the drill bit.

According to an aspect, the drill bit comprises an asymmetrically shaped head. According to another aspect, the asymmetrically shaped head comprises four distinct peripheral surfaces. According to another aspect, the four distinct peripheral surfaces comprise a first peripheral surface having a first shape, a second peripheral surface having a second shape different from the first shape, a third peripheral surface having a third shape different from the first and second shapes, and a fourth peripheral surface having a fourth shape different from the first, second and third shapes. According to another aspect, the first peripheral surface and the second peripheral surface are joined at an acute angle, the second peripheral surface and the fourth peripheral surface are joined at an obtuse angle, the fourth peripheral surface and the third peripheral surface are joined at an obtuse angle, and the third peripheral surface and the first peripheral surface are joined at an obtuse angle.

According to an aspect, the canister further comprises a percussive drill hammer that does not include a drill bit moveable between a radially retracted position and a radially extended position.

The present system uses multiple hammers configured in a manner that allows the assembly to drill predetermined diameter holes in soils, overburden, and rock. The underreaming hammers or drill bits are arranged at the outer diameter—or gage row—of the canister. The drill bits can rotate and are designed in a manner that the drill bit head cams, pivots, or swings out to a larger cutting diameter when the system is rotated in a first direction, e.g., clockwise. The system is rotated in a second direction, e.g., counterclockwise, to retract the bit heads. The bits are retracted to remove the canister from the casing or to drill a smaller diameter hole through rock.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
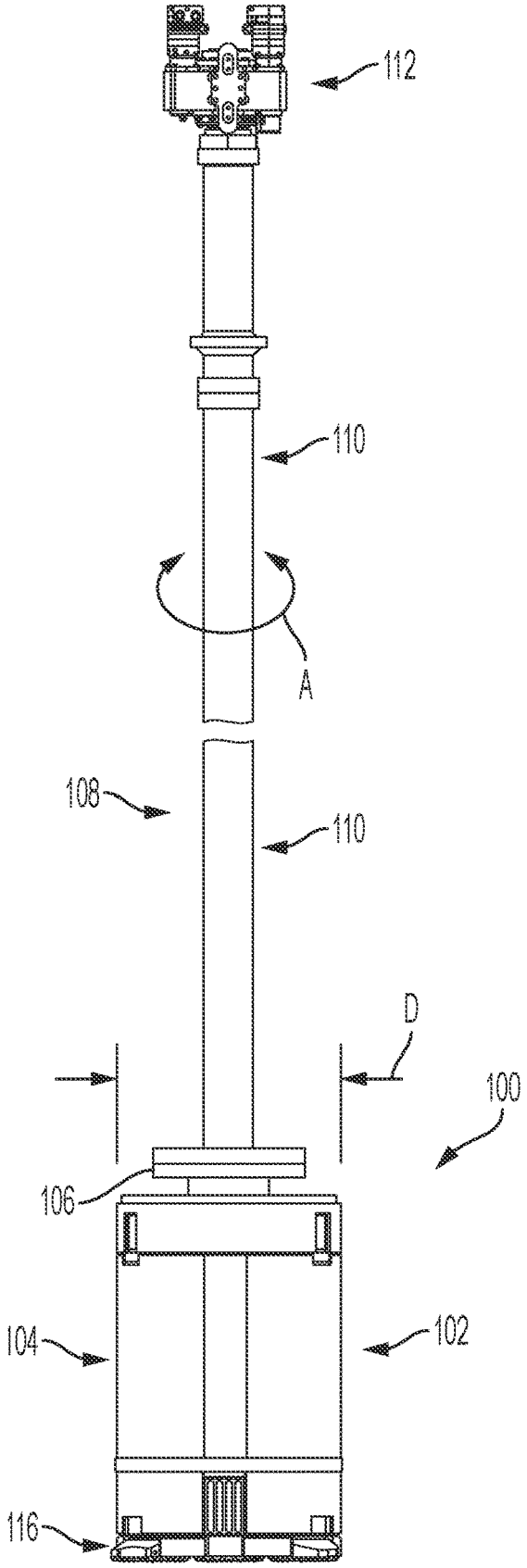
FIG. 1 is an elevational view of an underreamer drill hammer constructed in accordance with the subject disclosure shown connected to a drill string.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 2:
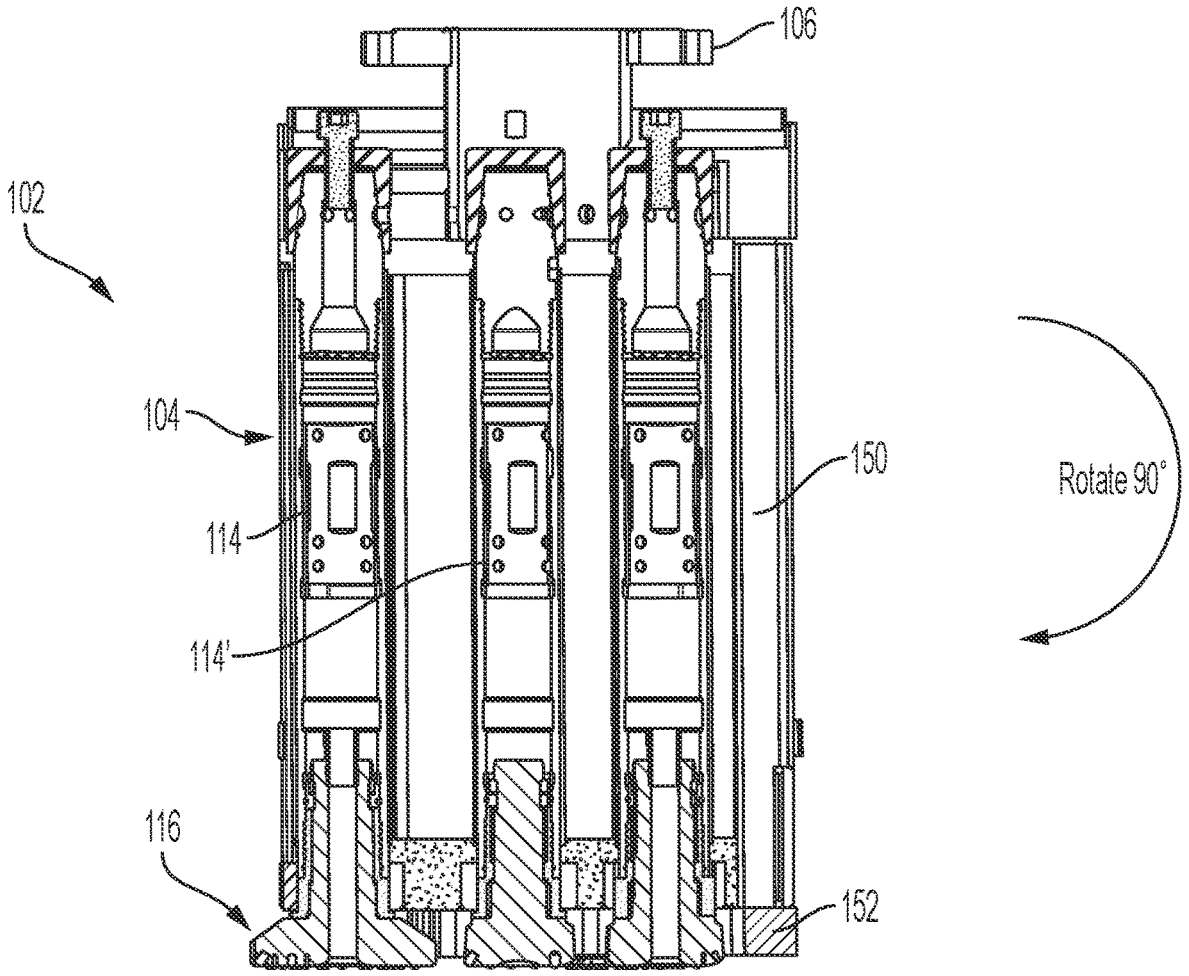
FIG. 2 is a longitudinal cross-sectional view of the underreamer drill hammer of FIG. 1.
Figure 3:
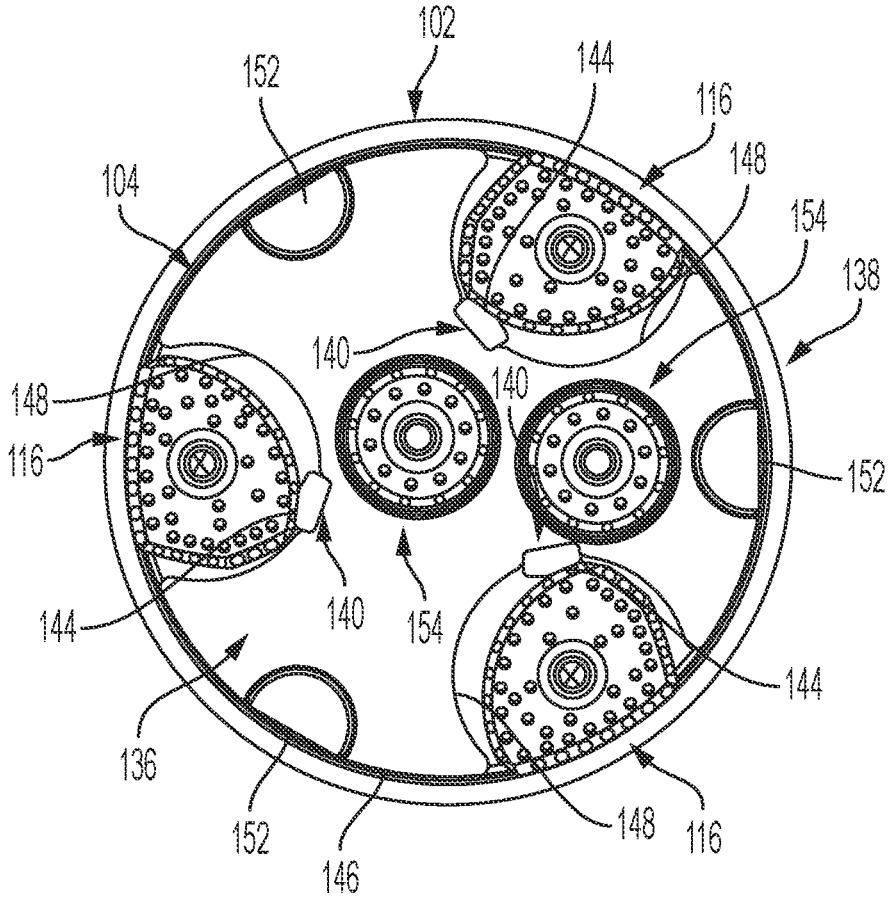
FIG. 3 is a view of a distal end of the underreamer drill hammer of FIG. 1 with drill bits thereof shown in a radially retracted position.

Referring to the drawings, FIG. 1 illustrates an underreamer drill hammer 100 constructed according to the subject disclosure comprising a canister 102 including a housing 104 having an outer diameter "D" and a proximal end 106 configured for attachment to a drill string 108. The drill string can comprise as few as one drill string segment 110 or a plurality of drill string segments together having a length sufficient to extend from a reversible drill string drive head 112 at the earth's surface to a desired depth beneath the surface, e.g., bedrock or even lower. The reversible drill string drive head is operable to rotate the drill string in both a clockwise and a counterclockwise direction as indicated by double-headed arrow "A". FIG. 2 shows that the canister 102 further includes a percussive drill hammer 114 housed within the housing 104. Operation of a percussive drill hammer is known in the art and is disclosed, e.g., in U.S. Pat. No. 8,302,707, the disclosure of which is incorporated herein in its entirety by reference thereto. However, unlike conventional percussive drill hammers, the percussive drill hammer 114 according to the subject disclosure has a drill bit 116 movable between a radially retracted position and a radially extended position. More particularly, rotation of the canister 102 in a first direction moves the drill bit into the radially extended position (FIGS. 4 and 6B) and rotation of the canister in a second direction opposite the first direction moves the drill bit into the radially retracted position (FIGS. 3 and 6C). According to an exemplary embodiment, the drill bit 116 is rotatably connected to the canister 102. In addition, the canister 102 further comprises a percussive drill hammer 114' that does not include a drill bit movable between a radially retracted position and a radially extended position.

Figure 4:
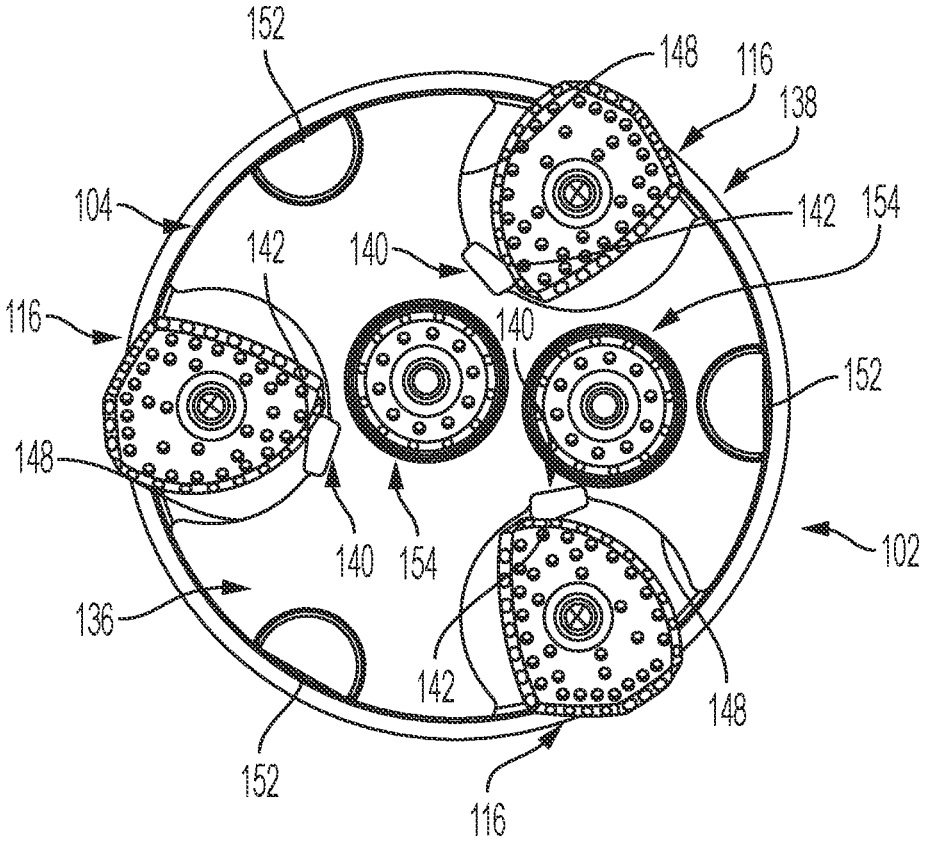
FIG. 4 is a view of the distal end of the underreamer drill hammer of FIG. 1 with drill bits thereof shown in a radially extended position.

FIG. 2 further illustrates that an outer surface of the canister 102 includes an axially directed recess 150 therein for permitting soil, overburden and rock cuttings to pass upwardly therethrough as the underreamer drill hammer drills downwardly. FIGS. 2-4 show that the canister further comprises a removable plug 152 at a distal end of the axially directed recess 150 for selective opening and closing of the axially directed recess. FIGS. 3 and 4 depict three equiangularly spaced plugs 152 for selectively covering three axially directed recesses.

Figure 5A:
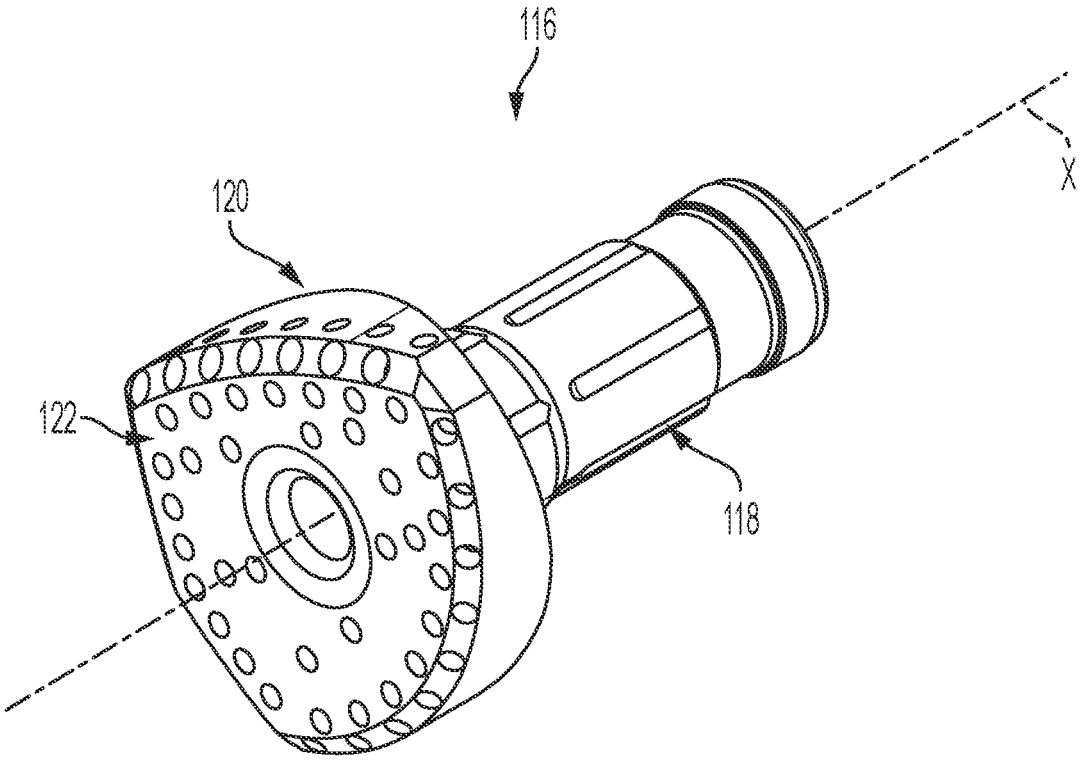
FIG. 5A is an enlarged perspective view of a drill bit of the underreamer drill hammer of FIG. 1 constructed in accordance with the subject disclosure.
Figure 5B:
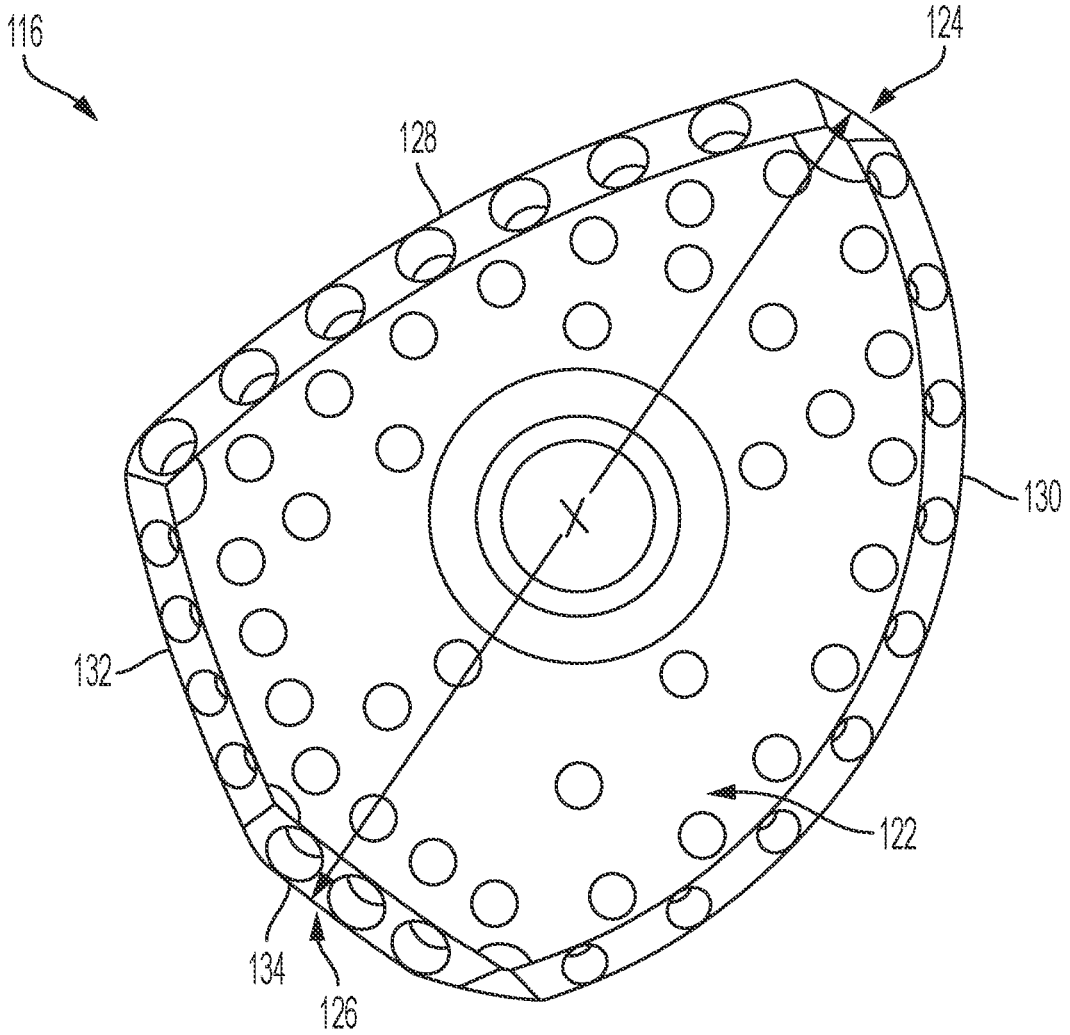
FIG. 5B is an enlarged view of a distally facing end of the drill bit of FIG. 5A.

Referring to FIGS. 5A and 5B, there is shown an exemplary embodiment of the construction of the drill bit 116. As shown in FIG. 5A, the drill bit 116 comprises a shank 118 having a longitudinal axis "X" and a head 120. The head includes a distally facing end 122 having a medial end 124 spaced from the longitudinal axis X a distance greater than the lateral end 126 of the distally facing end. The distally facing end 122 has a perimeter defined by a first arcuate portion 128 having a first arc length and a second arcuate portion 130 having a second arc length greater than the first arcuate portion. Additionally, the first arcuate portion 128 is defined by a first radius and the second arcuate portion 130 is defined by a radius less the first radius. The perimeter of the distally facing end 122 is further defined by a third portion 132 having a third perimeter length less than the first arc length and a fourth portion 134 having a fourth perimeter length less than the third perimeter length.

Stated differently, the head 120 includes a first curved peripheral surface (first arcuate portion 128), a second curved peripheral surface (second arcuate portion 130) having a curve steeper than the first curved peripheral surface, a third peripheral surface (third portion 132) and a fourth peripheral surface (fourth portion 134). In other words, the drill bit 116 comprises an asymmetrically shaped head comprising four distinct peripheral surfaces. The four distinct peripheral surfaces comprise a first peripheral surface 128 having a first shape, a second peripheral surface 130 having a second shape different from the first shape, a third peripheral surface 132 having a third shape different from the first and second shapes, and a fourth peripheral surface 134 having a fourth shape different from the first, second and third shapes.

According to an exemplary embodiment, the first peripheral surface 128 and the second peripheral surface 130 are joined at an acute angle, the second peripheral surface 130 and the fourth peripheral surface 134 are joined at an obtuse angle, the fourth peripheral surface 134 and the third peripheral surface 132 are joined at an obtuse angle, and the third peripheral surface 132 and the first peripheral surface 128 are joined at an obtuse angle.

Referring to FIG. 3, there is shown a distal end 136 of the canister 102 with the drill bit 116 in a radially retracted position (in the illustrated example there are three equiangularly spaced drill bits 116, although there may be more or less than three). In the radially retracted position, each drill bit does not extend radially outwardly further than an outer diameter of a casing 138 (see also FIG. 6C). Indeed, as described in greater detail in connection with FIG. 6C, in a fully radially retracted position the drill bit(s) 116 do not extend radially outwardly to an inner diameter of the casing 138, whereby the canister 102 may be withdrawn from the casing once the casing has come to rest on bedrock.

Referring to FIG. 4, there is shown the distal end 136 of the canister 102 with the drill bit 116 in a radially extended position (in the illustrated example there are three equiangularly spaced drill bits 116 (again, however, there may be more or less than three). In the radially extended position, each drill bit extends radially outwardly further than an outer diameter of a casing 138 (see also FIG. 6B), whereby the underreamer drill hammer 100 may cut through soil and overburden to bedrock while facilitating advancement of the casing 138 through the hole cut by the drill bit(s) 116.

Referring still to FIGS. 3 and 4, the underreamer drill hammer further comprises a stop 140 about the distal end 136 of the canister for engaging the drill bit 116 (in the illustrated example there are three equiangularly spaced stops 140 corresponding with drill bits 116, although there may be more or less than three depending on the number of drill bits employed). The stop 140 is positioned spaced from the longitudinal axis X of the shank of the drill bit so as to abut adjacent the medial end (FIG. 4) or lateral end (FIG. 3) of the distally facing end of the drill bit. In this regard, the stop 140 includes a first face 142 (FIG. 4) for engaging the drill bit when moved in the radially extended position and a second face 144 (FIG. 3) for engaging the drill bit when moved in the radially retracted position. In other words, the drill bit 116 comprises a head 120 having an arcuate portion e.g., second arcuate portion 130 (FIG. 5B), wherein the stop 140 engages a first end of the arcuate portion 130 when in the radially extended position and a second end of the arcuate portion opposite the first end when in the radially retracted position. FIGS. 3 and 4 further show that the canister 102 comprises a plate 146 at its distal end, the plate including a recess 148 for receiving the drill bit 116 (in the illustrated example there are three equiangularly spaced recesses 148 for accommodating the three illustrated drill bits; again, there may be more or less than three drill bits and recesses). FIGS. 3 and 4, further illustrate that the distal end 136 of the canister includes at least one drill bit 154 that is freely rotatable (i.e. unconstrained from rotation in either direction) but does not move between a radially retracted position and a radially extended position.

Figure 6A:
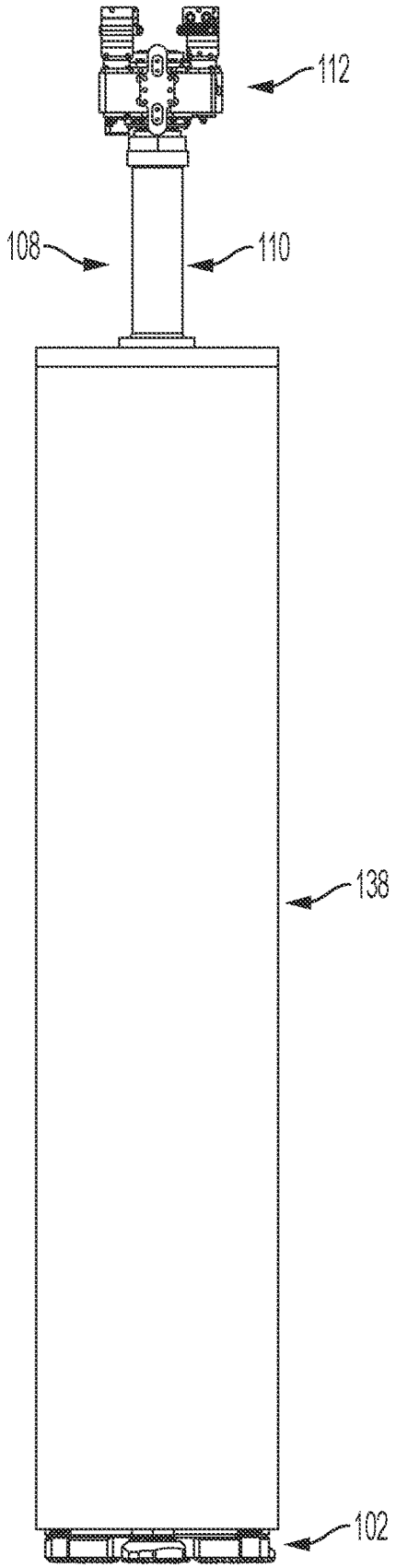
FIG. 6A is an elevational view of an underreamer drill hammer connected to a drill string and surrounded by a casing.
Figure 6B:
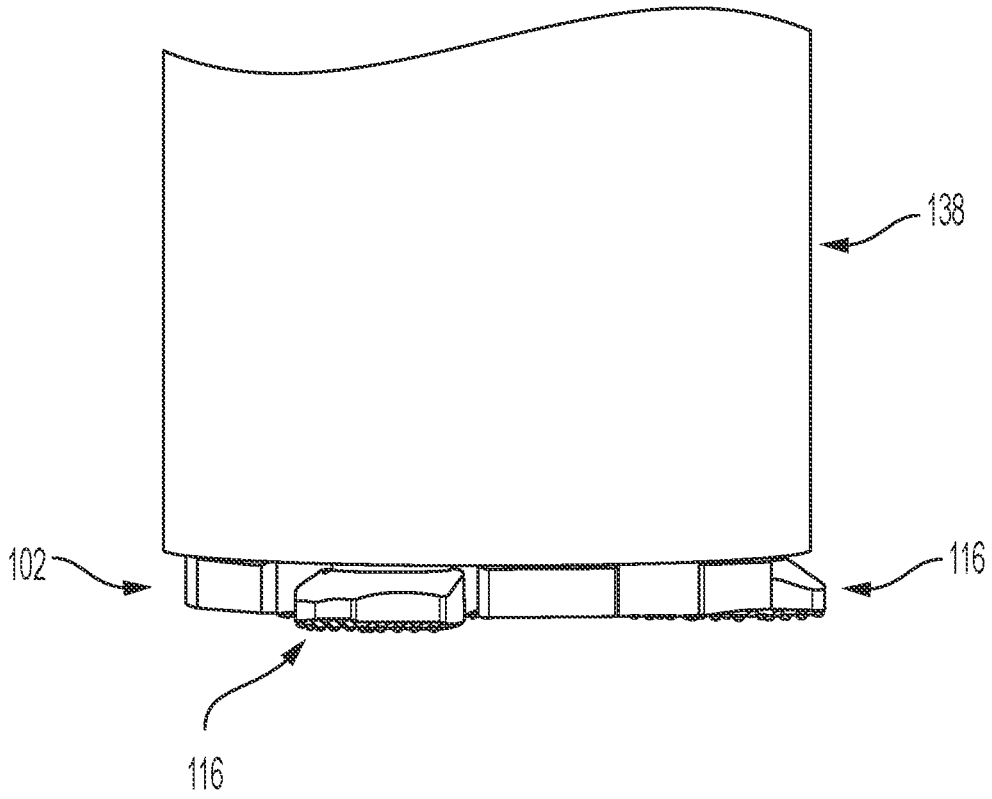
FIG. 6B is an enlarged view of a lower end of a casing with drill bits of an underreamer drill hammer constructed in accordance with the subject disclosure shown in radially extended positions.
Figure 6C:
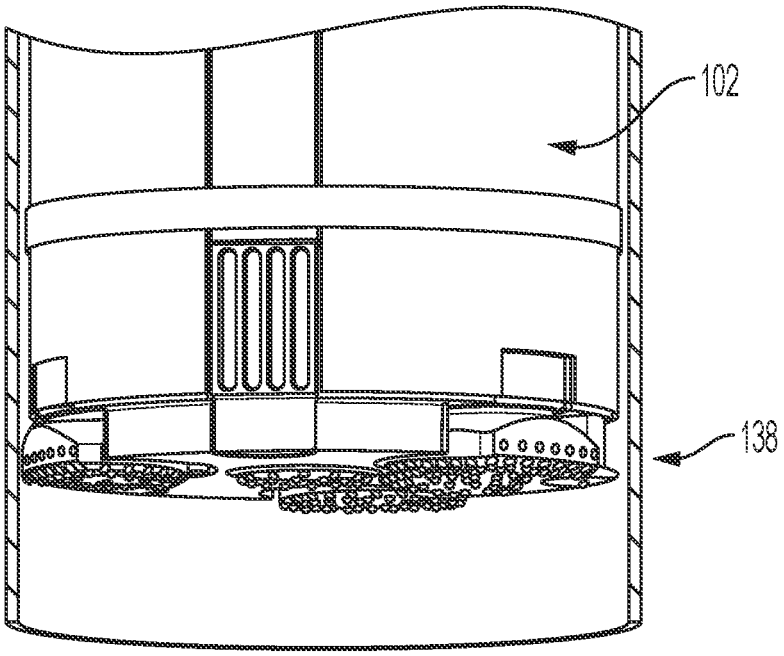
FIG. 6C is an enlarged, partial section view of a lower end of a casing with drill bits of an underreamer drill hammer constructed in accordance with the subject disclosure shown in a radially retracted positions.

Operation of the underreamer drill hammer 100 in accordance with the subject disclosure will be understood by reference to FIGS. 6A-6C. Referring to FIG. 6A there is shown a rigging including a length of casing 138 surrounding a length of drill string 108 and a canister 102 (the lower end of which is shown in FIGS. 6A and 6B). Such rigging may be, for example, an arrangement of the system prior to drilling into the earth. When drilling begins, the reversible drill string drive head 112 is operated to rotate the drill string in a first direction, e.g., clockwise, thereby causing the drill bit(s) 116 to pivot into a radially extended position such as is shown in FIGS. 4 and 6B. With the drill bit(s) 116 so disposed, downward drilling into soil and overburden may begin. As the drill bit(s) drill downwardly into the soil and overburden they cut a hole which is slightly larger in diameter than the outer diameter of the casing 138 whereby the casing may be readily lowered into the hole concurrently with the underreamer drill hammer. It is understood that, as drilling progresses, a suitable number of drill string segments 110 and casing segments may be added to the to the drill string and casing, respectively, in order for the underreamer drill hammer to reach bedrock and the casing to come to rest upon the bedrock. Once the casing 138 approaches bedrock, either of two things can occur. One, the reversible drill string drive head 112 can be operated to rotate the drill string in a second direction opposite the first direction, e.g., counterclockwise, thereby causing the drill bit(s) 116 to pivot into a radially retracted position such as is shown in FIGS. 3 and 6C. With the drill bit(s) 116 so disposed, the casing comes to rest on the bedrock and the canister 102 may be raised upwardly through the casing for removal from the casing at the earth's surface. Two, with the casing 138 resting on bedrock and the drill bit(s) 116 pivoted into the radially retracted position, continued rotation of the drill string in the second direction while lowering the drill string causes the drill bit(s) 116 to drill a smaller diameter hole (substantially equivalent to the diameter D of the canister housing 104) into the bedrock for additional anchoring of the casing if such may be required. Once the hole in the bedrock is completed, the canister 102 may be raised upwardly through the casing for removal at the earth's surface as described above.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

We claim:

1. An underreamer drill hammer comprising:

a canister having:

a housing having an outer diameter, a proximal end configured for attachment to a drill string, a plurality of percussive drill hammers housed within the housing, each percussive drill hammer having a single drill bit movable between a radially retracted position and a radially extended position; and a stop about a distal end of the canister for engaging the drill bit.

2. The underreamer drill hammer of claim 1, wherein rotation of the canister in a first direction moves the drill bit into the radially extended position and rotation of the canister in a second direction opposite the first direction moves the drill bit into the radially retracted position.

3. The underreamer drill hammer of claim 1, wherein the drill bit comprises a shank having a longitudinal axis and a distally facing end having a medial end spaced from the longitudinal axis a distance greater than a lateral end of the distally facing end.

4. The underreamer drill hammer of claim 1, wherein the drill bit comprises a distally facing end having a perimeter defined by a first arcuate portion having a first arc length, and a second arcuate portion having a second arc length greater than the first arcuate portion.

5. The underreamer drill hammer of claim 4, wherein the first arcuate portion is defined by a first radius and the second arcuate portion is defined by a radius less than the first radius.

6. The underreamer drill hammer of claim 4, wherein the perimeter of the distally facing end is further defined by a third portion having a third perimeter length less than the first arc length.

7. The underreamer drill hammer of claim 6, wherein the perimeter of the distally facing end is further defined by a fourth portion having a fourth perimeter length less than the third perimeter length.

8. The underreamer drill hammer of claim 1, wherein, in the radially retracted position, the drill bit does not extend radially outwardly further than an outer diameter of a casing.

9. The underreamer drill hammer of claim 1, wherein, in the radially extended position, the drill bit extends radially beyond an outer diameter of a casing.

10. The underreamer drill hammer of claim 1, wherein the drill bit comprises a head including a first curved peripheral surface, a second curved peripheral surface having a curve steeper than the first curved peripheral surface, and a third peripheral surface.

11. The underreamer dill hammer of claim 1, wherein the stop is positioned spaced from a longitudinal axis of a shank of the drill bit so as to abut adjacent the medial end or lateral end of a distally facing end of the drill bit.

12. The underreamer drill hammer of claim 1, wherein the stop includes a first face for engaging the drill bit when moved in the radially extended position and a second face for engaging the drill bit when moved in the radially retracted position.

13. The underreamer drill hammer of claim 1, wherein the drill bit comprises a head having an arcuate portion, and wherein the stop engages a first end of the arcuate portion when in the radially extended position and a second send end of the arcuate portion opposite the first end when in the radially retracted position.

14. The underreamer drill hammer of claim 1, wherein the canister further comprises a plate at a distal end of the canister, and wherein the plate includes a recess for receiving the drill bit.

15. The underreamer drill hammer of claim 1, wherein the drill bit comprises an asymmetrically shaped head.

16. The underreamer drill hammer of claim 15, wherein the asymmetrically shaped head comprises four distinct peripheral surfaces.

17. The underreamer drill hammer of claim 16, wherein the four distinct peripheral surfaces comprise a first peripheral surface having a first shape, a second peripheral surface having a second shape different from the first shape, a third peripheral surface having a third shape different from the first and second shapes, and a fourth peripheral surface having a fourth shape different from the first, second and third shapes.

18. The underreamer drill hammer of claim 17, wherein the first peripheral surface and the second peripheral surface are joined at an acute angle, the second peripheral surface and the fourth peripheral surface are joined at an obtuse angle, the fourth peripheral surface and the third peripheral surface are joined at an obtuse angle, and the third peripheral surface and the first peripheral surface are joined at an obtuse angle.

19. The underreamer drill hammer of claim 1, wherein the canister further comprises another percussive drill hammer that does not include a drill bit moveable between a radially retracted position and a radially extended position.

20. An underreamer drill hammer comprising:

a canister having:

a housing having an outer diameter, a proximal end configured for attachment to a drill string, a plurality of percussive drill hammers housed within the housing, each percussive drill hammer having a single drill bit movable between a radially retracted position and a radially extended position; and a plate at a distal end of the canister including a recess for receiving the drill bit.

21. An underreamer drill hammer comprising:

a canister having:

a housing having an outer diameter, a proximal end configured for attachment to a drill string, a plurality of percussive drill hammers housed within the housing, each percussive drill hammer having a single drill bit movable between a radially retracted position and a radially extended position; and another percussive drill hammer that does not include a drill bit moveable between a radially retracted position and a radially extended position.

* * * * *